US010232864B2

(12) United States Patent
Sato et al.

(10) Patent No.: US 10,232,864 B2
(45) Date of Patent: Mar. 19, 2019

(54) TRUCK FOR RAILCAR

(71) Applicant: KAWASAKI JUKOGYO KABUSHIKI KAISHA, Kobe-shi, Hyogo (JP)

(72) Inventors: Yoshi Sato, Kobe (JP); Masahiro Hamada, Kobe (JP); Junichi Sakamoto, Kobe (JP); Koichi Murata, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 244 days.

(21) Appl. No.: 15/026,042

(22) PCT Filed: Oct. 25, 2013

(86) PCT No.: PCT/JP2013/079648
§ 371 (c)(1),
(2) Date: Mar. 30, 2016

(87) PCT Pub. No.: WO2015/059840
PCT Pub. Date: Apr. 30, 2015

(65) Prior Publication Data

US 2016/0229426 A1 Aug. 11, 2016

(51) Int. Cl.
*B61F 5/36* (2006.01)
*B61F 3/06* (2006.01)
(Continued)

(52) U.S. Cl.
CPC ..... *B61F 5/36* (2013.01); *B61F 3/02* (2013.01); *B61F 3/06* (2013.01); *B61F 5/30* (2013.01); *B61F 5/301* (2013.01)

(58) Field of Classification Search
CPC ..... B61F 3/10; B61F 5/06; B61F 5/10; B61F 5/36
See application file for complete search history.

(56) References Cited

U.S. PATENT DOCUMENTS 3,841,232 A * 10/1974 Hess ..... B61F 1/06 105/171
5,632,208 A 5/1997 Weber
(Continued)

FOREIGN PATENT DOCUMENTS

CN 102348588 A 2/2012
FR 2573023 A1 5/1986
(Continued)

OTHER PUBLICATIONS

Jul. 23, 2014 Search Report issued in International Patent Application No. PCT/JP2013/079648.
(Continued)

*Primary Examiner* — Zachary L Kuhfuss
(74) *Attorney, Agent, or Firm* — Oliff PLC

(57) ABSTRACT

There is provided a three-axle truck for a railcar having three wheelsets in a truck frame of the one truck, in which in each of the wheelsets, axle boxes are supported by the truck frame through axle springs, the truck frame has a structure for supporting a carbody whose weight is variable, and making variations in axle loads on the respective wheelsets be maintained at a preset value or less in spite of change of the carbody weight, and in this structure, spring constants of the both-end axle springs in the respective wheelsets located at both ends of three axles are set to be larger than a spring constant of the middle axle spring of the wheelset located in the middle.

2 Claims, 4 Drawing Sheets

(51) Int. Cl.
*B61F 5/30* (2006.01)
*B61F 3/02* (2006.01)

(56) References Cited

U.S. PATENT DOCUMENTS

| | | | | |
|---|---|---|---|---|
| 7,954,436 | B2 * | 6/2011 | Gorski | B61F 5/36 105/166 |
| 8,196,519 | B2 * | 6/2012 | Kumar | B61F 3/06 105/194 |
| 8,313,111 | B2 * | 11/2012 | Ahuja | B61F 5/36 280/124.151 |
| 8,371,231 | B2 * | 2/2013 | Kumar | B61C 15/04 105/73 |
| 8,371,232 | B2 * | 2/2013 | Kumar | B61C 15/06 105/73 |
| 8,371,233 | B2 * | 2/2013 | Kumar | B61C 15/04 105/73 |
| 8,418,626 | B2 * | 4/2013 | Gorski | B61F 5/36 105/157.1 |
| 8,424,888 | B2 * | 4/2013 | Ahuja | B61C 15/14 180/209 |
| 8,443,735 | B2 * | 5/2013 | Kumar | B61F 5/36 105/157.1 |
| 8,448,962 | B2 * | 5/2013 | Kalyani | B61F 5/36 267/175 |
| 8,468,952 | B2 * | 6/2013 | Worden | B61F 5/36 105/157.1 |
| 8,584,596 | B1 * | 11/2013 | Worden | B61F 5/36 105/157.1 |
| 8,677,909 | B2 * | 3/2014 | Kumar | B61F 3/06 105/75 |
| 8,935,983 | B2 * | 1/2015 | Kumar | B61C 15/04 105/194 |
| 9,623,883 | B2 * | 4/2017 | Sato | B61F 5/52 |
| 2009/0031915 | A1 * | 2/2009 | Kumar | B61C 15/04 105/34.1 |
| 2009/0031916 | A1 * | 2/2009 | Kumar | B61C 15/06 105/34.1 |
| 2009/0031917 | A1 * | 2/2009 | Kumar | B61C 15/04 105/35 |
| 2009/0095194 | A1 * | 4/2009 | Kumar | B61C 15/04 105/73 |
| 2009/0095195 | A1 * | 4/2009 | Kumar | B61C 15/04 105/96 |
| 2009/0095197 | A1 * | 4/2009 | Kumar | B61C 15/04 105/96 |
| 2009/0099714 | A1 * | 4/2009 | Kumar | B61C 15/04 701/19 |
| 2010/0170413 | A1 | 7/2010 | Kumar et al. | |
| 2010/0175580 | A1 | 7/2010 | Gorski et al. | |
| 2011/0082606 | A1 * | 4/2011 | Kumar | B61C 15/04 701/19 |
| 2012/0167797 | A1 | 7/2012 | Worden et al. | |
| 2012/0173056 | A1 * | 7/2012 | Kumar | B61C 15/04 701/20 |
| 2013/0253739 | A1 * | 9/2013 | Kumar | B61C 15/04 701/19 |

FOREIGN PATENT DOCUMENTS

| | | | |
|---|---|---|---|
| JP | S51-93511 | U | 7/1976 |
| JP | S59-100051 | A | 6/1984 |
| NZ | 204854 | A | 9/1985 |
| WO | 2010/083201 | A1 | 7/2010 |

OTHER PUBLICATIONS

Jul. 23, 2014 Written Opinion issued in International Patent Application No. PCT/JP2013/079648.

Mar. 1, 2017 Office Action issued in Chinese Patent Application No. 201380080477.9.

Zhi-hui Huang et al. "Design of Primary Spring for Three-Axle Bogie". Electric Drive for Locomotives, No. 4, Jul. 10, 2005, pp. 36, 37, and 48.

Rui Zhang et al. "Research on Support Mode in Three-Axle Bogie Fatigue Test". Railway Quality Control, vol. 39, No. 12, Dec. 15, 2011, pp. 23-25.

Kailin Zhang et al. "Influence of Primary Spring Stiffness on Strength of Co Bogie Frame". Journal of Southwest Jiaotong University, vol. 43, No. 3, Jun. 2008, pp. 377-380.

* cited by examiner

TRUCK FOR RAILCAR

TECHNICAL FIELD

The present invention relates to a truck for a railcar, and particularly to a three-axle truck for a railcar.

BACKGROUND ART

There is a three-axle truck that is used, for example, in a locomotive or the like, and has three wheelsets in the one truck. In this three-axle truck as well as in a two-axle truck, axle boxes of each of the wheelsets are supported through axle springs by side frames of a truck frame so as to be vertically movable, so that a carbody load of a locomotive or the like is distributed to rails through the truck frame, each of the axle springs and each of the wheelsets. Here, all the axle springs used on the respective wheelsets are the same. Respective axle loads on these three wheelsets need to be the same for the following reason.

In the locomotive, the respective wheelsets are basically driven with the same tractive torque, and thus, if the respective axle loads on the three wheelsets are uneven, wheel slip is caused in the wheelset having the smaller axle load because of a lower adhesion force to a rail. This wheel slip may cause a degradation of the tractive effort of the locomotive and a damage of a wheel tread and a rail surface.

Moreover, even with a trailing truck not equipped with an electric motor, there are also similar problems in a freight car with braking force control in which a braking force is adjusted in response to a weight applied to the truck of the freight car. That is, if the respective axle loads on the three wheelsets are uneven, sliding is caused at the time of braking control in the wheelset having the smaller axle load because of a lower adhesion of the wheelset in the smaller axle load to the rail. As a result, the damage of the wheel tread and the rail surface are caused.

The unevenness of the axle loads, which causes the above-described problem, is caused in a three-axle truck by a truck frame deflection with a concave shape caused by a carbody load F acting on a central portion of a truck frame 10 as shown in FIG. 5. As a result of this deflection, an axle load r2 on a middle wheelset 2 of the three wheelsets becomes larger than an axle load r1 on each of the wheelsets 1, 3 at both ends.

As one of solutions of the above-described problem, there is a technique of inserting a liner between each axle box and each axle spring in each of the wheelsets located at both the ends of the three-axle truck to equalize the imposed loads on the respective axle springs of the three wheelsets.

Moreover, there also exists a technique of providing equalizer beams between the axle box of the middle wheelset and the axle boxes of the wheelsets at both the ends, respectively.

PRIOR ART DOCUMENTS

Patent Documents

Patent Document 1: Japanese Utility Model Laid-open Publication No. S51-93511

Patent Document 2: Japanese Patent Laid-open Publication No. S59-100051

SUMMARY OF INVENTION

Problems to be Solved by the Invention

However, in the aforementioned technique of equalizing the imposed loads of the axle springs of the three wheelsets by the insertion of the liners, when the carbody load acting on the three-axle truck changes, a deflection amount of the truck frame changes as described with reference to FIG. 5, and thus, the imposed loads on the respective axle springs change and become uneven. Thus, there is a problem that the adjustment by the liners is required every change of the carbody load.

On the other hand, in the technique of providing the equalizer beams, even when the carbody load acting on the three-axle truck changes, the imposed loads on the respective axle springs can be equalized. However, since the equalizer beams need to be newly provided, there are problems that a structure of the three-axle truck is complicated, and that components and a weight are increased, and costs are increased.

The present, invention is devised in order to solve the above-described problems, and an object thereof is to provide a truck for a railcar in which imposed loads on respective axle springs are even in spite of change of a carbody load, and a degree of the complication of a truck structure is lower than that in the related art.

Solutions to the Problems

In order to achieve the above-described object, the present invention is constituted as follows.

Namely, a truck for a railcar in one aspect of the present invention has at least three wheelsets in a truck frame of the one truck, in which in each of the wheelsets, axle boxes are supported by the truck frame through axle springs, the truck being configured such that spring constants of both-end axle springs in the respective wheelsets located at both ends of the at least three wheelsets are set to be larger than a spring constant of a middle axle spring, which is an axle spring of at least one wheelset other than those at the both ends.

According to the truck for a railcar, setting the spring constants of the axle springs in the respective wheelsets located at the both ends of at least three wheelsets to be larger than the spring constant in the middle wheelset can make imposed loads of the respective axle springs even in spite of the change of the carbody load. Furthermore, the configuration of using the axle springs having the different spring constants prevents the structure of at least three-axle truck from being complicated.

Moreover, even in the configuration in which a carbody whose weight is variable is supported by the truck for a enables variations of the axle loads on the wheelsets to be maintained at a prescribed value or lower in spite of the change of the carbody weight.

Effects of the Invention

According to the truck for a railcar in one aspect of the present invention, a truck for a railcar in which the imposed loads on the respective axle springs are even in spite of the change of the carbody load, and the degree of the complication of, the truck structure is lower than that in the related art can be provided.

DESCRIPTION OF EMBODIMENTS

A truck for a railcar as an embodiment will be described below with reference to the drawings. In the respective drawings, the same or similar components are given the same reference signs. Moreover, to avoid redundancy of the following description and facilitate the understanding of those in the art, a detailed description of an item already known well and an overlapped description of substantially the same configuration may be omitted. Moreover, the following description and contents of the accompanying drawings are not intended to limit the gist of the claims.

Figure 3:
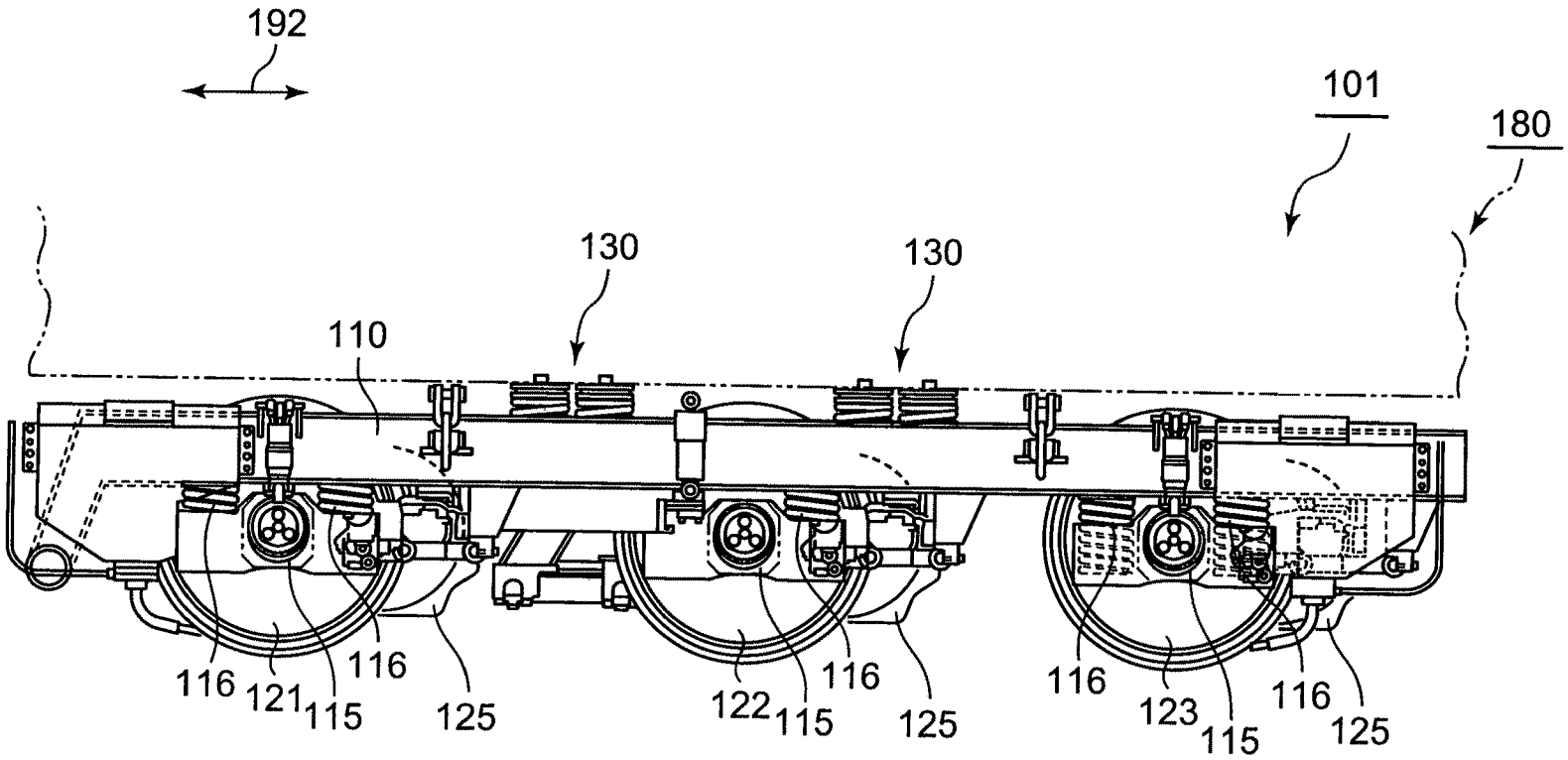
FIG. 3 is a side view of the truck for the railcar in the embodiment.
Figure 4:
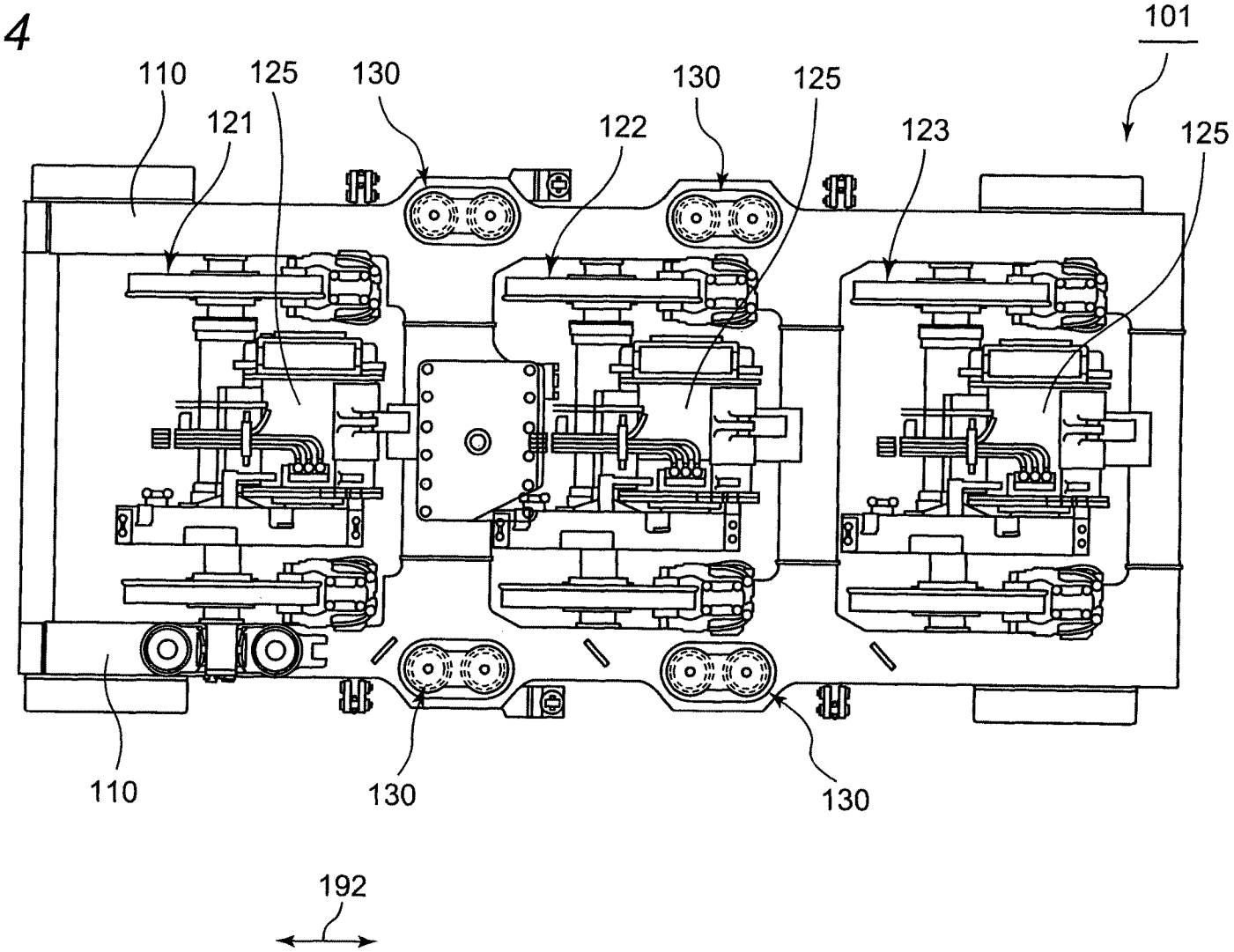
FIG. 4 is a plane view of the truck for the railcar shown in FIG. 3.
Figure 5:
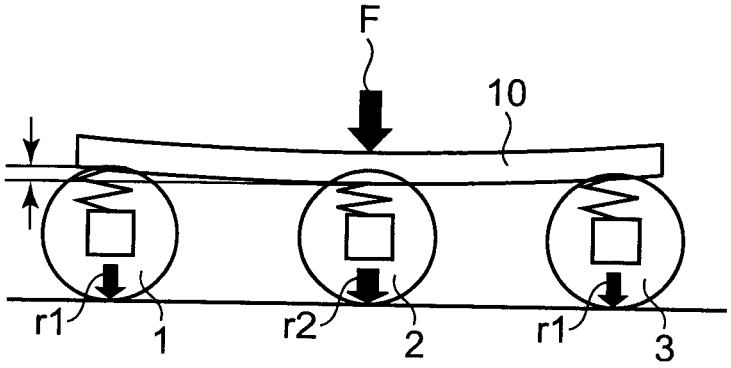
FIG. 5 is a model diagram showing load distribution in a conventional three-axle truck.

FIG. 3 shows one truck for a railcar (hereinafter, simply referred to as a "truck") 101 in the present embodiment. This truck 101 has three wheelsets 121, 122, 123, and in each of the wheelsets 121, 122, 123, axle boxes 115 are supported by side frames of a truck frame 110 through axle springs 116 each made of a coil spring so as to be vertically movable. Moreover, the truck frame 110 of the truck 101 is manufactured by welding steel plates. The above-described truck 101 is used in an electric locomotive as one example, and the wheelsets 121, 122, 123 each have an electric motor 125 to be individually driven. In one electric locomotive, the two trucks 101 are arranged along the car length direction 192, and a load of a carbody 180 of the electric locomotive acts on side frames of the truck through secondary springs 130 each made of a coil spring near the middle wheelset 122 in the truck frame 110 of each of the trucks 101.

On the other hand, for the above-described electric locomotive, a structure may be employed in which a carbody weight is variable in accordance with track strength of a railroad section where the electric locomotive runs. Thus, the truck 101 needs to correspond to the above-described change of the carbody weight. Furthermore, with respect to the truck 101, a specification, that defines that variations in axle loads among the wheelsets 121, 122, 123 are not more than a preset value, for example, not more than 1%, in spite of the change of the carbody weight, may be imposed.

The truck 101 of the present embodiment has structure satisfying the above-described condition. Specifically, in the truck 101, spring constants of the respective axle springs 116 in the wheelsets 121, 122, 123 are adjusted so that the variations in the axle loads are not more than the preset value, that is, the axle loads on the wheelsets, 121, 122, 123 are even or almost even, even when the carbody weight changes.

This adjustment will be described below with reference to FIGS. 1 and 2.

Figure 1:
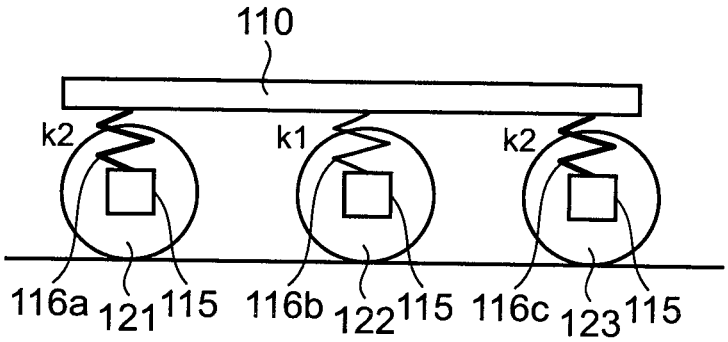
FIG. 1 is a model diagram for analysis of a truck for a railcar in an embodiment.

FIG. 1 is a model diagram for analysis of the truck 101 to set the string constants of the axle springs 116, wherein there is a structure model in which in all the wheelsets 121, 122, 123, the axle spring 116 is provided between each of the axle boxes 115 and the truck frame 110. Here, the axle springs 116 for the wheelsets 121, 122, 123 are labeled as an axle spring 116*a*, an axle spring 116*b*, and an axle spring 116*c*, respectively.

In the present embodiment, spring constants k2 of the axle springs 116*a*, 116*c* in the wheelsets 121, 123 located at both ends of the three wheelsets are set to be larger than a spring constant k1 of the axle spring 116*b* in the wheelset 122 located in the middle of the three wheelsets. Hereinafter, the axle springs 116*a*, 116*c* may be referred to as both-end axle springs 116*a*, 116*c*, and the axle spring 116*b* may be referred to as a middle axle spring 116*b*.

This adjustment of the spring constants of the respective axle springs 116 will be described below with reference to FIG. 2.

Figure 2:
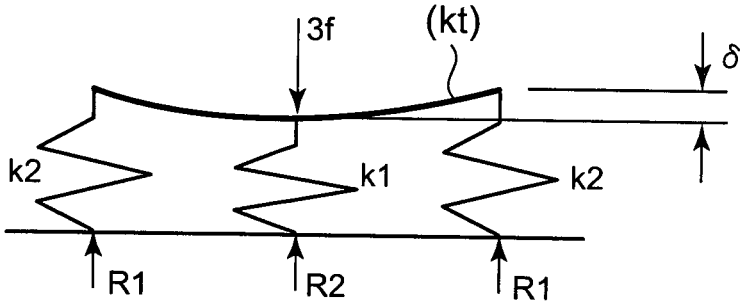
FIG. 2 is a load distribution diagram corresponding to the model diagram in FIG. 1.

FIG. 2 is a load distribution diagram corresponding to the model in FIG. 1. Here, Reference sign 3*f* denotes an imposed load on the truck 101, including its own weight of the truck frame 110. Two reference sign R1*s* denote loads acting on the both-end axle springs 116*a*, 116*c* in the respective wheelsets 121, 123 located at the both ends of the three-axle truck 101, and a load consisting of the load R1 and a unsprung mass such as the wheelset weight corresponds to each of axle roads of the wheelsets 121, 123. Reference sign R2 denotes a load acting on the middle axle spring 116*b* in the wheelset 122 located in the middle of the three-axle truck 101. Reference sign k1 denotes the spring constant of the middle axle spring 116*b* in the wheelset 122. Two reference sign k2*s* denote the spring constants of the both-end axle springs 116*a*, 116*c* in the wheelsets 121, 123, respectively.

Here, the truck frame 110 is simplified by the side frame thereof, and the carbody load acts on a center of the side frame, that is, above the wheelset 122 located in the middle. At this time, the side frame bends with a deflection amount δ. Further a spring constant of the side frame in the deflection at a position of each of the both-end axle springs 116*a*, 116*c* with respect to a position supporting the carbody load in the side frame, that is, a spring constant of the side frame having a spring action is denoted as kt.

As just described, by employing a consideration that the truck frame 110, the side frame in the above-described model, bends with the carbody load, it turns out that the spring constants of the both-end axle springs 116*a*, 116*c* in the wheelsets 121, 123 located at the both ends of the three wheelsets are preferably set to be larger with value corresponding to a spring stiffness in the spring action, i.e., the above deflection of the side frame, that the side frame has. Namely, the spring constants of the both-end axle springs 116*a*, 116*c* in the wheelsets 121, 123 at the both ends are set to be larger than the spring constant of the middle axle spring 116*b* in the wheelset 122 in the middle.

In other words, it can also be said that a difference between the spring constants of the both-end axle springs 116*a*, 116*c* in the wheelsets 121, 123 at the both ends, and the spring constant of the middle axle spring 116*b* in the middle wheelset 122 is set in accordance with the spring stiffness of the truck frame 110, and more particularly, it can also be said that according to the following condition [1], the difference is increased exponentially as the spring stiffness of the truck frame 110 is decreased.

Setting k2>k1 as described above can make a combined spring constant by the truck frame 110 and the axle springs 116 uniform at positions of the wheelsets 121, 123 in the both ends and the wheelset 122 in the middle. As a result, even when the carbody load changes, the respective axle springs 116*a* to 116*c* of the wheelsets 121 to 123 can have a uniform axle-spring imposed load, and the axle loads on the wheelsets 121 to 123 can be equalized.

Referring to the model in FIG. 2, a condition under which the loads. R1*s* acting on the both-end axle springs 116*a*, 116*c* in the wheelsets 121, 123 at the both ends respectively, and the load R2 acting on the middle axle spring 116*b* in the wheelset 122 in the middle become the same regardless of the change of the carbody load will be mentioned below. As this condition, relevant spring constants k1, k2, and kt only need to satisfy the following condition [1]. In other words, by setting the respective spring constants k1, k2, and kt so as to satisfy the following condition [1], the specification for the variations of the axle loads among the wheelsets 121, 122, 123 being not more than the preset value, for example, not more than 1% can be satisfied.

$$1/k1=1/k2+1/kt$$

Thus, the following relationship only needs to be satisfied:

$$k2=1/((1/k1)-(1/kt)) \quad [1]$$

As an example that satisfies the above-described condition [1], k2=912 N/mm can be considered in case of k1=874 N/mm and kt=20976 N/mm.

As described above, according to the truck 101 of the present embodiment, by setting the spring constants of the both-end axle springs 116*a*, 116*c* in the wheelsets 121, 123 at the both ends to be larger than the spring constant of the middle axle spring 116*b* in the wheelset 122 in the middle, and at this time, the respective spring constants k1, k2, and kt to satisfy the above-described condition [1], even when the carbody load changes, the axle loads in the wheelsets 121 to 123 can be equalized.

As a result, even when the wheelsets 121 to 123 are driven with the same tractive torque, wheel slip does not occur in the wheelsets. Accordingly, traction performance is not decreased in the locomotive or the like, and also, the wheel tread and the rail surface can be prevented from the damage by the wheel slip.

Furthermore, according to the truck 101 of the present embodiment, the axle springs having different spring constants only need to be used, and even when the weight of the carbody supported by the truck 101 changes, further adjustment work is not required, and further, the structure of the three-axle truck does not need to be complicated, and further, there are not posed problems of increase in component, weight and cost.

While in the present embodiment, as described above, the spring constants of the both-end axle springs 116*a*, 116*c* are set to have the same value, however they may be made different. Namely, in some the carbody load application points, the respective spring constants of the axle spring 116*a* and the axle spring 116*c* may be different.

While in the above-described embodiment, the three-axle truck for electric locomotive has been described as one example, the truck of the present embodiment may be applied to a freight car. Moreover, the present embodiment can be applied to a three or more-axle truck.

INDUSTRIAL APPLICABILITY

The present invention is applicable to three or more-axle truck for electric locomotive or for freight car.

DESCRIPTION OF REFERENCE SIGNS

101: Truck for railcar, 110: Truck frame, 115: Axle box, 116: Axle spring, 116*a* and 116*c*: Both-end axle spring, 116*b*: Middle axle spring, 121, 122, and 123: Wheelset, and
180: Carbody.

The invention claimed is:

1. A truck for a railcar comprising at least three wheelsets in a truck frame of the truck, each of the wheelsets include an axle box that is supported by the truck frame through axle springs, the truck being configured such that spring constants of both-end axle springs, which are axle springs in the respective wheelsets located at both ends of the at least three wheelsets, are set to be larger than a spring constant of a middle axle spring, which is an axle spring of at least one wheelset other than those at the both ends, and the spring constants of both-end axle springs are set to be larger than the spring constant of the middle axle spring by an amount that is based on a spring stiffness in the spring action of a side frame of the truck frame.

2. A truck for a railcar comprising at least three wheelsets in a truck frame of the truck, each of the wheelsets includes an axle box that is supported by the truck frame through axle springs, the truck being configured such that the spring constants of both-end axle springs in the respective wheelsets located at both ends of the at least three wheelsets are set to be larger than a spring constant of a middle axle spring, which is an axle spring of at least one wheelset other than those at both ends, and assuming that the spring constant of the middle axle spring is k1, the spring constants of the both-end axle springs are k2, and the spring constant in the spring action of the truck frame with respect to a carbody load is kt, wherein the following relationship therebetween is established, $$k2=1/((1/k1)-(1/kt)).$$

* * * * *